US005137565A

United States Patent [19]

Thelin et al.

[11] Patent Number: 5,137,565

[45] Date of Patent: Aug. 11, 1992

[54] METHOD OF MAKING AN EXTREMELY FINE-GRAINED TITANIUM-BASED CARBONITRIDE ALLOY

[75] Inventors: Anders G. Thelin, Vällingby; Rolf G. Oskarsson, Rönninge; Gerold Weinl, Älvsjö, all of Sweden

[73] Assignee: Sandvik AB, Sandviken, Sweden

[21] Appl. No.: 808,749

[22] Filed: Dec. 17, 1991

[30] Foreign Application Priority Data

Dec. 21, 1990 [SE] Sweden ..... 9004122-9

[51] Int. Cl.[5] ..... C22C 29/04

[52] U.S. Cl. ..... 75/238; 75/236; 75/239; 75/240; 419/10; 419/13; 419/17; 419/18; 419/23; 419/33

[58] Field of Search ..... 75/236, 238, 239, 240; 419/10, 13, 17, 18, 23, 33

[56] References Cited

U.S. PATENT DOCUMENTS

| | | | |
|---|---|---|---|
| 4,783,216 | 11/1988 | Kemp et al. | 75/342 |
| 4,894,090 | 1/1990 | Ekemar et al. | 75/252 |
| 4,943,322 | 7/1990 | Kemp et al. | 420/417 |
| 5,032,174 | 7/1991 | Ekemar et al. | 75/354 |

*Primary Examiner*—Stephen J. Lechert, Jr.
*Attorney, Agent, or Firm*—Burns, Doane, Swecker & Mathis

[57] ABSTRACT

According to the present invention there is now provided a method of making a sintered titanium-based carbonitride alloy. According to the method, melt-metallurgical raw materials containing the metallic alloying elements for hard constituent-forming as well as binder phase-forming elements are melted and cast, using no intentional additions of the elements C, N, B and O, to form a pre-alloy which in solidified condition of brittle intermetallic phases with hard constituent-forming and binder phase-forming elements mixed in atomic scale. The pre-alloy is crushed and/or milled to powder with grain size <50 μm. The powder is carbonitrided for simultaneous formation in situ of extremely fine-grained <0.1 μm, hard constituent particles enclosed in their binder phase. The obtained powder is milled together with lubricant and possible additions of powders of metals, carbides and/or nitrides from the groups IV, V or VI in the Periodic Table in order to obtain desired final analysis after which the powder is compacted and sintered.

9 Claims, 1 Drawing Sheet

METHOD OF MAKING AN EXTREMELY FINE-GRAINED TITANIUM-BASED CARBONITRIDE ALLOY

BACKGROUND OF THE INVENTION

The present invention relates to a method of making an extremely fine-grained titanium-based carbonitride alloy.

Titanium-based carbonitrides, often named cermets, are known for having considerably better wear resistance but at the same time inferior toughness behavior than conventional, i.e., WC-Co based, cemented carbide at the same content of hard constituents. Such carbonitride alloys are therefore used most often for extreme finishing at high speed under stable conditions at which they generate very fine surfaces on the work piece. At the same time, they maintain their tolerances for a long time because of their superior wear resistance.

One reason for the better wear resistance of titanium-based hard materials compared to tungsten-based materials is that the titanium hard constituents have much better chemical stability than tungsten hard constituents. The very much active diffusional wear mechanism at high temperature has thus essentially a lower effect for titanium-based hard materials. Another effect of the good chemical stability is a decreased tendency to clad the work-piece material onto the tool.

Methods used to improve the toughness behavior are to increase the content of binder phase which leads to impaired high temperature properties and decreased wear resistance. Alternatively, an improved toughness behavior at maintained binder phase content can be obtained by increasing the grain size.

The established experience within the powder metallurgy art, particularly within cemented carbide technique and industry, is that a reduction of the grain size at a constant binder phase content leads to increased hardness and decreased toughness. The increasing hardness and the decreasing toughness have been related to the decrease of the free mean path length in the binder phase. This is well-known to those skilled in the art and it is therefore logical to increase the grain size in order to increase the toughness.

OBJECT OF THE INVENTION

It is an object of the invention to avoid or alleviate the problems of the prior art.

It is also an object of the invention to provide an improved method for making a titanium-based carbonitride alloy having superior toughness behavior and wear resistance as well as the resulting product.

SUMMARY OF THE INVENTION

There is provided the method of making a sintered titanium-based carbonitride alloy comprising casting a pre-alloy of hard constituent-forming and binder phase-forming metals without intentional additions of C, N, B, and/or O to form a cast pre-alloy of brittle intermetallic phases of hard constituent-forming metals and binder phase-forming metals mixed in atomic scale, forming a powder of a grain size <50 μm of the said pre-alloy, carbonitriding said powder to form in situ, extremely fine-grained hard constituent particles within the binder phase metals, compacting and sintering the said carbonitrided powders as well as the product made by that method.

DETAILED DESCRIPTION OF THE PREFERRED EMBODIMENTS OF THE INVENTION

According to the present invention, it has now been surprisingly found that an opposite effect to that expected by the skilled artisan will be obtained by a sufficient decrease of the free mean path length. Contrary to all established knowledge, a considerably improved toughness behavior is obtained.

Figure 1:
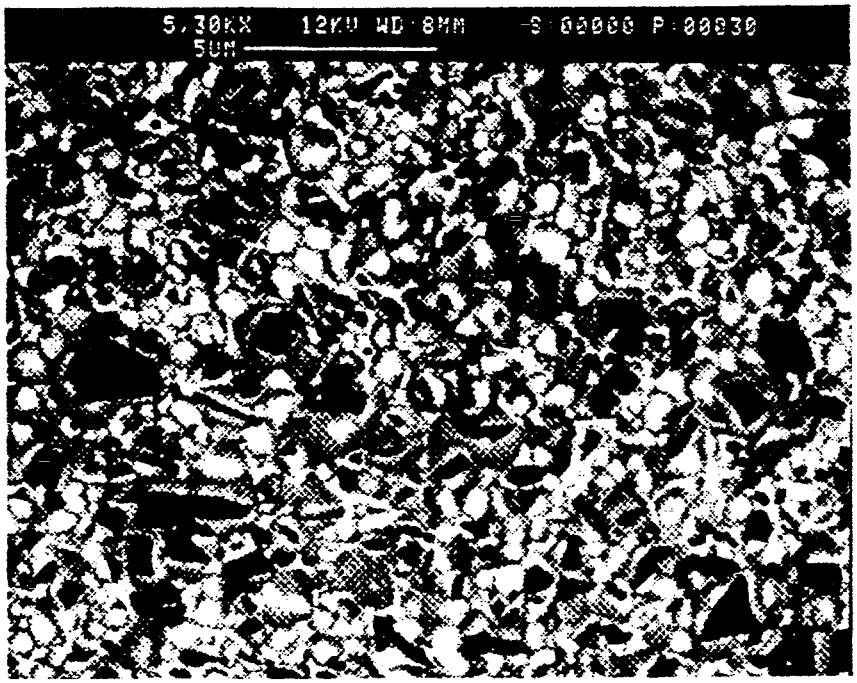
FIG. 1 shows in 5300 X the structure of a conventional titanium-based carbonitride alloy.

The structure of a "normal" titanium-based carbonitride alloy is shown in FIG. 1. Such material is well-known and gives, as earlier mentioned, very good wear resistance but in many cases insufficient toughness behavior. Intermittent cutting often gives great failures in such material. The hardness of the material according to FIG. 1 is 1650 HV3.

Figure 2:
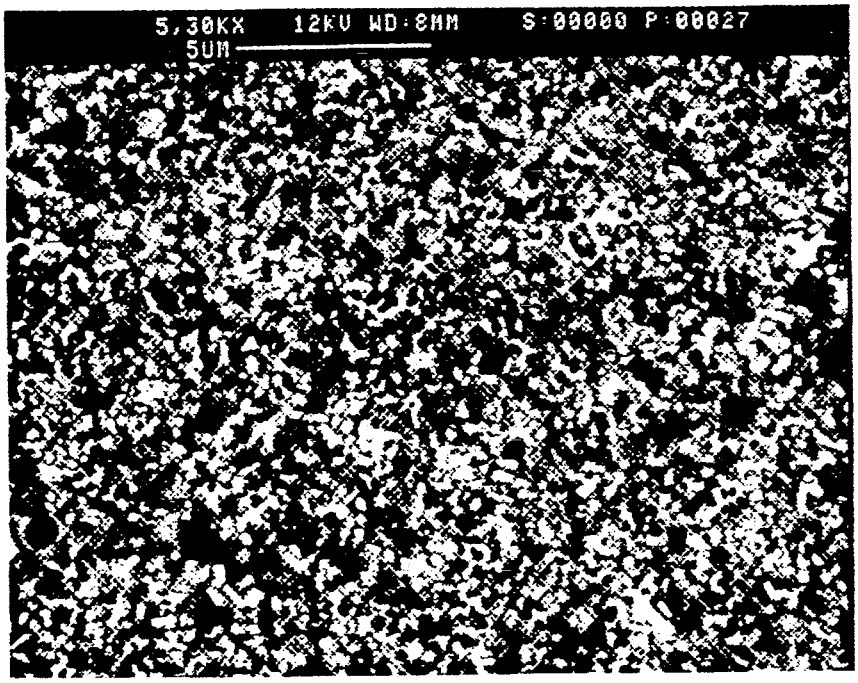
FIG. 2 shows in 5300 X the structure of titanium-based carbonitride alloy according to the invention.

It has now been found that a material with considerably improved toughness behavior can be obtained by maintaining the same binder phase content as in the material according to FIG. 1, even the same total chemical composition, but changing the grain size of the hard constituents down to a mean grain size of 0.5–1.0 μm. The hardness of said material is 1700 HV3. The structure of material according to the present invention is shown in FIG. 2.

It has also been found that the unexpected effect of increased toughness behavior at decreased grain size and unchanged binder phase content is strengthened at a binder phase content <20% by volume, preferably <18% by volume, and mostly <16% by volume. At the same time it is difficult to obtain such a fine-grained structure with a homogenous composition in the microstructure unless the binder phase contents are >5% by volume, preferably >7% by volume.

A method of producing a sufficiently fine grain size alloy starts from melt-metallurgically produced intermetallic pre-alloys, i.e., without interstitial alloying elements such as carbon, oxygen and nitrogen, which pre-alloys are then carburized, nitrided and/or carbonitrided in the solid state. A material of this type is disclosed in U.S. Pat. No. 4,145,213 which relates to hard materials containing 30–70% by volume of hard constituents with properties between those of conventional cemented carbide, i.e., WC-Co based, and of high speed steel. The present invention relates to a material with more than 70% by volume of hard constituents and which has properties on the other side of cemented carbide, i.e., the more wear resistant but at the same time less tough side. The material according to U.S. Pat. No. 4,145,213 is based upon the established knowledge that a decreased grain size of the hard constituents gives an increased hardness. Consequently, the binder phase content could be strongly increased but the material as such remained a hard material.

The present invention relates to a titanium-based hard material with more than 70% by volume of hard constituents. Titanium is the dominating hard constituent former which means that more than 50 mole-% of the metallic elements of the hard constituents is titanium.

Other metals are Zr, Hf, V, Nb, Ta, Cr, Mo and/or W. Small additions of Al can also occur, but they are mainly in the binder phase, which is based on Fe, Ni and/or Co, preferably Ni and Co.

The material according to the present invention is suitably produced by melting of melt-metallurgical raw materials containing the metallic alloying elements for the hard constituent-forming as well as the binder phase-forming elements but without intentional additions of the elements C, N, B and O. The melt is then cast to an intermetallic pre-alloy which in solidified condition consists essentially of brittle intermetallic phases with hard constituent-forming and binder phase-forming elements mixed in atomic scale. Said alloy can have a composition which completely or almost completely corresponds to the finally intended one. It can also be a so-called base alloy meaning that it can be used for many different grades by adjusting the composition in connection with the final milling. It has been found that, e.g. the tungsten or molybdenum content influences how much nitrides can be present in the final alloy. Thus, a high content of nitrides demands not only low amounts of particularly tungsten but also limited contents of molybdenum. It is thus suitable to have only a small amount of Mo+W, generally <10%, preferably <7%, by weight, in the base alloy. Said metals are also difficult to melt and get uniformly distributed in the pre-alloy when applied in large amounts.

The base alloy is produced melt-metallurgically under inert gas atmosphere or in vacuum. Also, the casting is protected in the same way.

The alloy is then disintegrated into powder form. This can be done, e.g., directly from the melt by inert gas granulation in an explosion-proof equipment or by mechanical dividing of the solidified ingot. The final disintegration of the pre-alloy should be performed in a protected environment, suitably wet milling in an oxygen-free environment, i.e., in an oxygen-free milling liquid and where also the air in the gas space of the mill has been replaced by a protective atmosphere such as argon or nitrogen. It has been found that some nitriding here is no drawback.

In connection with the final milling, the carbon intended for the later carburizing can be added in solid state. In this fashion, a fine distribution of the carbon is obtained so that the reaction in a later step starts at about the same time throughout the whole charge.

After milling of the pre-alloy to desired grain size, <50 μm, preferably <30 μm, the milling liquid is removed and carbonitriding of the base alloy is performed at a temperature low enough that no melting takes place. In order to obtain fine-grained hard constituents the temperature is generally <1200° C., preferably <1100° C. It is important that removal and carbonitriding are performed in a closed system which is protected from contact with an air atmosphere. Otherwise, an uncontrolled reaction can take place.

When all the reactive metals in the base alloy, i.e., the hard constituent formers, have reacted with carbon and/or nitrogen, the furnace charge can be cooled to room temperature. Not until then should the furnace charge be exposed to the air atmosphere because then stable compounds are present.

The powder of extremely fine-grained hard constituent particles, ≦0.2 μm, preferably ≦0.1 μm, enclosed in their binder phase, are milled together with lubricant and possibly other additions of powders of metals, carbides and/or nitrides from the groups IV, V, or VI in the Periodic Table, e.g., WC, W, TiC, TiN, TaC, etc., in order to give the desired final composition after which the obtained powder mixture is pressed and sintered in a conventional manner.

To the same base alloy, additions of various amounts of carbon and nitrogen can be made to give powders with completely different properties in the final product because of changes in the carbon/nitrogen balance. Thus, e.g., a higher content of carbon and corresponding lower content of nitrogen means a harder and more wear resistant but also less tough alloy. In the same way, a higher content of nitrogen and a lower content of carbon gives a tougher but less wear resistant alloy concerning abrasive wear. Because the nitrides are more stable than the corresponding carbides, the resistance to diffusional wear can be improved, however, at the same time. Diffusional wear is in most cases observed as cratering while abrasive wear usually is found as flank wear. Furthermore, additions of other hard material powders and similar can in the same way give final products having completely different properties.

Because the carbonitrided base alloy is very fine-grained, it can be suitable to pre-mill the "additions" before the main raw material is added.

The invention is additionally illustrated in connection with the following Examples which are to be considered as illustrative of the present invention. It should be understood, however, that the invention is not limited to the specific details of the Examples.

EXAMPLE 1

A pre-alloy of the metals Ti, Ta, V, Co, Ni was made in a vacuum induction furnace at 1450° C. in Ar protecting gas (400 mbar). The composition of the ingot after casting in the ladle was in % by weight: Ti 66, Ta 8, V 6, Ni 8, and Co 12. After cooling, the ingot was crushed to a grain size ≦1 mm. The crushed powder was milled together with necessary carbon addition in a ball mill with paraffin as milling liquid to a grain size ≦50 μm. The pulp was poured on a stainless plate and placed in a furnace with a tight muffle. The removal of the milling liquid was done in flowing hydrogen gas at the temperature 100°-300° C. After that, the powder was carbonitrided in solid phase by addition of nitrogen gas. The total cycle time was 7 h including three evacuations in order to retard the procedure. The carburizing occurs essentially at the temperature 550°-900° C. Then the final carbonitride charge was cooled in nitrogen gas.

The finishing powder manufacture was done in conventional ways, i.e., additional raw materials (WC and $Mo_2C$) were added and milled together with the carbonitride charge to final powder which was spray-dried in usual ways.

EXAMPLE 2

Cutting inserts of type: TNMG 160408-QF were manufactured of the alloy according to the Example 1, with the following analysis in mole-%: Ti 62.4, Ta 2.3, V 4.7, W 6.2, Mo 7.0, Co 10.0, Ni 7.4 and of a similar powder made in conventional way. The difference in composition was less than 1%. The cutting inserts of the latter material were used as references in a toughness test. The two variants had the same edge radius and edge rounding. The cutting inserts were tested by cutting of a plank package up to failure. Cutting data at the initial engagement was:

$v = 110$ m/min $f_o = 0.11$ mm/rev a = 1.5 mm

Work piece: SS 2244

The feed was increased linearly until all the cutting inserts had failed. After that the accumulated failure frequency was determined as a function of time to failure. The value of 50% failure frequency for a certain feed was given as comparison figure for the toughness behavior.

30 edges per variant were tested with the following result:

| | Feed where 50% of the edges have failed, mm/rev. |
|---|---|
| The reference | 0.120 |
| According to the invention | 0.145 |

Student's t-test shows that the confidence level for differences between the materials is >99.99%. If the number of victories per variant is considered the material according to the invention wins in 95% of the tests. The result can also be formulated so that cutting inserts made according to the invention will last 2.5 times longer than the reference until 50% of the cutting inserts have failed.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method of making a sintered titanium-based carbonitride alloy comprising casting a pre-alloy of hard constituent-forming and binder phase-forming metals without intentional additions of C, N, B, and/or O to form a cast pre-alloy of brittle intermetallic phases of hard constituent-forming metals and binder phase-forming metals mixed in atomic scale, mixed, forming a powder of a grain size <50 μm of the said pre-alloy, carbonitriding said powder to form in situ, extremely fine-grained hard constituent particles having a diameter ≦0.1 μm within the binder phase metals, compacting and sintering the said carbonitrided powders.

2. The method of claim 1 wherein the powder is formed with a grain size <30 μm.

3. The method of claim 1 wherein the powder after carbonitriding is mixed with powders of other metals, metal carbides, and/or metal nitrides, said metal being selected from the group consisting of groups IV, V or VI of the Periodic Table.

4. The method of claim 1 wherein the binder phase metal content of the said alloy is >5% and <20% by volume.

5. The method of claim 4 wherein the binder phase metal content is >7% and <18%.

6. The method of claim 5 wherein the binder phase metal content is >7% and <16%.

7. The method of claim 1 wherein the carbonitriding is performed at a temperature <1200° C.

8. The method of claim 7 wherein the carbonitriding is performed at a temperature <1100° C.

9. The product of the process of claim 1.

* * * * *